US005455753A

United States Patent [19]

Vollmann et al.

[11] Patent Number: 5,455,753

[45] Date of Patent: Oct. 3, 1995

[54] SYNTHETIC-RESIN LAMP HOLDER

[75] Inventors: Axel Vollmann; Ulrich Spintge, both of Sprockhövel, Germany

[73] Assignee: Otto Vollmann GmbH & Co., Gevelsberg, Germany

[21] Appl. No.: 142,245

[22] Filed: Oct. 22, 1993

[30] Foreign Application Priority Data

Oct. 27, 1992 [DE] Germany ..... 92 14 524.8 U

[51] Int. Cl.[6] ..... F21V 21/02; F21V 29/00

[52] U.S. Cl. ..... 362/226; 362/457; 362/427; 362/430; 313/318; 439/619; 439/699.2; 439/558

[58] Field of Search ..... 362/226, 457, 362/310, 427, 267, 285, 429, 430, 287; 439/611, 619, 699, 557, 558; 313/51, 318

[56] References Cited

U.S. PATENT DOCUMENTS

| | | | |
|---|---|---|---|
| 2,125,053 | 7/1938 | Scepaniak | 362/226 X |
| 2,388,029 | 10/1945 | Bates | 362/310 |
| 2,853,595 | 9/1958 | Baldwin | 362/226 |
| 3,379,872 | 4/1968 | Devine, Jr. | 362/443 |
| 3,717,758 | 2/1973 | Willis | 362/226 |
| 4,513,356 | 4/1985 | Mikola | 362/226 |
| 4,742,436 | 5/1988 | Hoggett | 362/285 X |
| 5,134,554 | 7/1992 | Donato et al. | 362/226 |

*Primary Examiner*—Ira S. Lazarus
*Assistant Examiner*—Thomas M. Sember
*Attorney, Agent, or Firm*—Herbert Dubno; Andrew Wilford

[57] ABSTRACT

A plate-like support has a pair of opposite faces and is formed with a throughgoing opening. A synthetic-resin lamp holder having a longitudinally open socket is formed with a foot projecting generally perpendicularly of the socket through the opening and formed with respective longitudinally spaced front and back abutments bearing on one of the faces of the support and respective side retaining formations between the abutments. A plug engaged snugly against the other face of the support between the abutments of the foot is formed with a pair of retaining formations lookingly engageable with the formations of the foot. An electrical wire extends through the plug, through the opening, and between the abutments to the socket.

13 Claims, 10 Drawing Sheets

Fig. 8
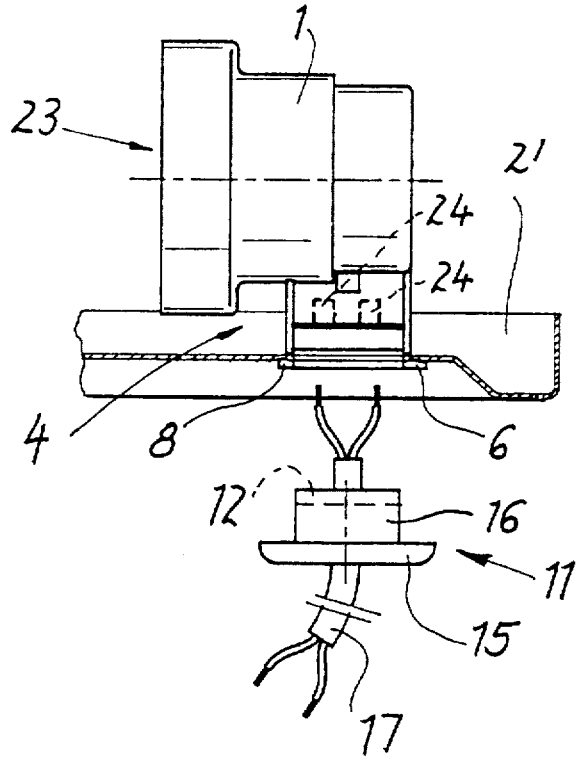
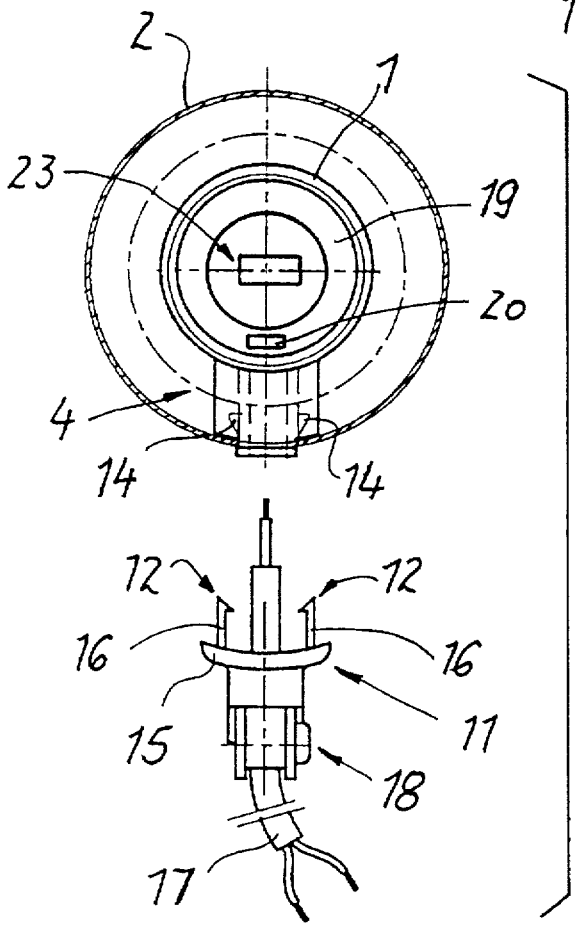
Fig. 7

Fig. 14
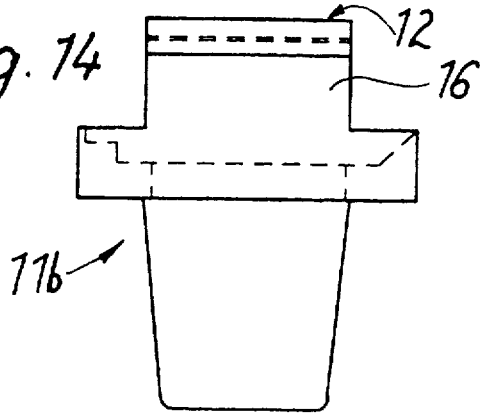
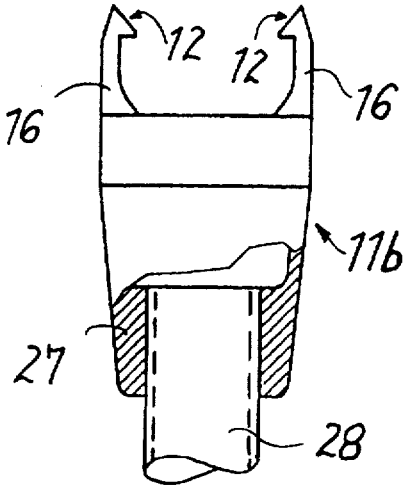
Fig. 15
Fig. 16
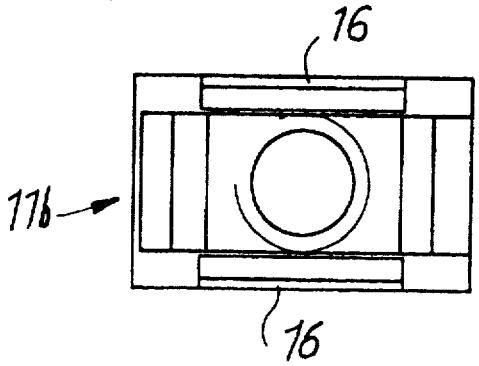
Fig. 17
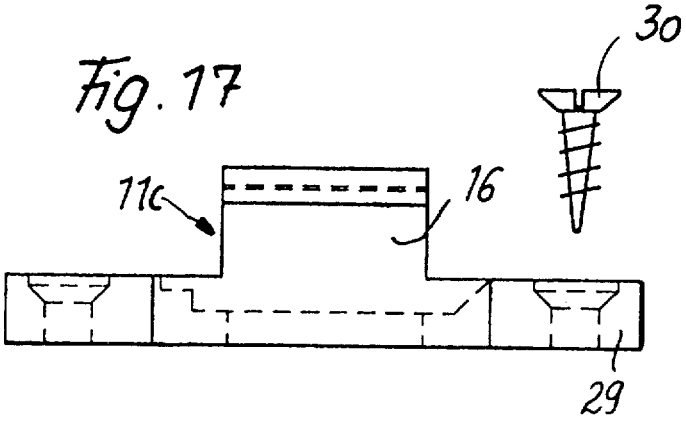
Fig. 18
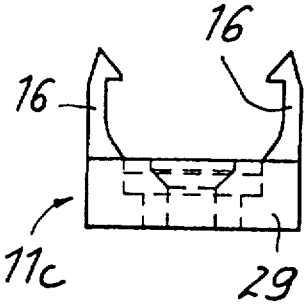
Fig. 19
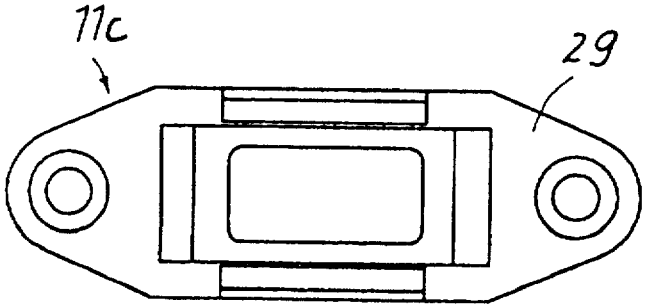

SYNTHETIC-RESIN LAMP HOLDER

SPECIFICATION

1. Field of the Invention

The present invention relates to a synthetic-resin lamp socket. More particularly this invention concerns such a socket used in a clip-on or track-type lamp.

2. Background of the Invention

A typical lamp assembly comprises a socket accommodating the fluorescent or incandescent bulb and a base on which the socket is mounted. Typically the socket has some sort of foot that is secured to the base or to a support. This support can be or include a reflector that surrounds the socket.

In all such arrangements (see German utility model 8,803,765) the parts are held together by screw fasteners or complicated snap arrangements. When the lamp is to be put together by the end user, this is particularly problematic, as parts can get lost or the assembly can be done wrong to create a real hazard of electrical shock. Furthermore once assembled with the aid of various tools, the lamp is frequently not very strong.

A further disadvantage of the known systems is that they are relatively complex and expensive to manufacture.

OBJECTS OF THE INVENTION

It is therefore an object of the present invention to provide an improved lamp.

Another object is the provision of such an improved lamp which overcomes the above-given disadvantages, that is which is easy to assemble without the use of specialized tools or extra parts, which is inexpensive to manufacture, and which is very robust once put together.

SUMMARY OF THE INVENTION

A lamp assembly has according to the invention a platelike support having a pair of opposite faces and formed with a throughgoing cruciform opening having longitudinally confronting front and back notches and transversely confronting side notches. The front and back notches have respective straight front and back edges spaced apart by a predetermined first longitudinal distance and each side notch also has straight front and back edges spaced apart by a predetermined second longitudinal distance. All the front and back edges are generally parallel. A synthetic-resin lamp holder has a longitudinally open socket and is formed with a foot projecting generally perpendicularly of the socket and fitted to the opening. The foot is formed with respective longitudinally spaced front and back abutments engaging one of the faces of the support longitudinally forward and rearward of the side notches, respective front and back retaining tabs extending through the front and back notches to engage the other face of the support and having outer edges turned away from each other and spaced apart by a third longitudinal distance slightly greater than the first longitudinal distance and inner edges also turned away from each other and one of which is spaced from the outer edge of the other tab by a fourth longitudinal distance at most as great as the first longitudinal distance. The inner edges confront and are closely juxtaposed with the respective front and back edges of the front and back notches. Respective side retaining formations between the abutments are generally aligned with the side notches. A plug having a surface engaging the other face of the support is formed with a pair of transversely deflectable tongues engaged in the side notches and each of a longitudinal dimension slightly smaller than the second longitudinal distance. The tongues are formed with portions releasably engageable with the respective side retaining formations. An electrical wire extends through the plug, through the opening, and between the abutments to the socket.

With this arrangement the electrical connection can be made after the socket is mounted on the support, and then the plug can be inserted to protect the connection. Virtually none of this wiring needs to be in the support, where it would be exposed to substantial heat. Furthermore with the system of this invention the socket is very solidly mounted so that it will not be twisted off the support during, for example, bulb changing.

The retaining tabs can both be rigid and fixed on the foot. Alternately one of the retaining tabs is rigid and fixed on the foot and the other is formed as a deflectable finger extending from the foot and through the opening at the respective notch. The deflectable finger is spaced longitudinally from the foot at the opening to form a gap and the plug is formed with a wall portion generally filling the gap and thereby preventing deflection of the finger toward the foot. The finger has an outer end hooked through the opening and engaging the other face of the support. Furthermore the plug is formed with a shield portion engaging around the outer end of the finger.

The foot according to the invention can be formed with a throughgoing passage receiving the wire. The retaining formations are barbs formed on the foot and the tongues are formed as hooks engageable over the respective barbs. This protects the wire from the sharp edges of the opening in the support.

According to a further feature of the invention the socket is centered on a longitudinally extending axis and is formed with a wall extending generally perpendicular to the axis and formed with a longitudinally forwardly open recess so that a tool can be engaged in the recess to steady the socket as the foot is fitted to the opening. The recess has a generally rectangular mouth extending tangentially of the axis and this recess is immediately adjacent the foot. For best support of the screwdriver or other tool steadying the socket the socket is formed with a longitudinally extending passage forming the recess.

In accordance with this invention the support is a longitudinally flaring reflector. In addition the plug is formed with a swivel joint.

According to a simpler aspect of the invention a platelike support has a pair of opposite faces and is formed with a throughgoing opening. A synthetic-resin lamp holder having a longitudinally open socket is formed with a foot projecting generally perpendicularly of the socket through the opening and formed with respective longitudinally spaced front and back abutments bearing on one of the faces of the support and respective side retaining formations between the abutments. A plug engaged snugly against the other face of the support between the abutments of the foot is formed with a pair of retaining formations lockingly engageable with the formations of the foot. An electrical wire extends through the plug, through the opening, and between the abutments to the socket.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing:

FIG. 7 is a cross section taken along line VII—VII of FIG. 6;

FIG. 8 is a sectional view through a variant of the lamp of FIGS. 1 through 7;

FIG. 14 is a side view of yet another plug according to the invention;

FIG. 15 is a partly sectional end view of the plug of FIG. 14;

FIG. 16 is a top view of the plug of FIG. 14;

FIG. 17 is a side view of another plug according to the invention;

FIG. 18 is an end view of the plug of FIG. 17;

FIG. 19 is a top view of the plug of FIG. 17;

SPECIFIC DESCRIPTION

Figure 1:
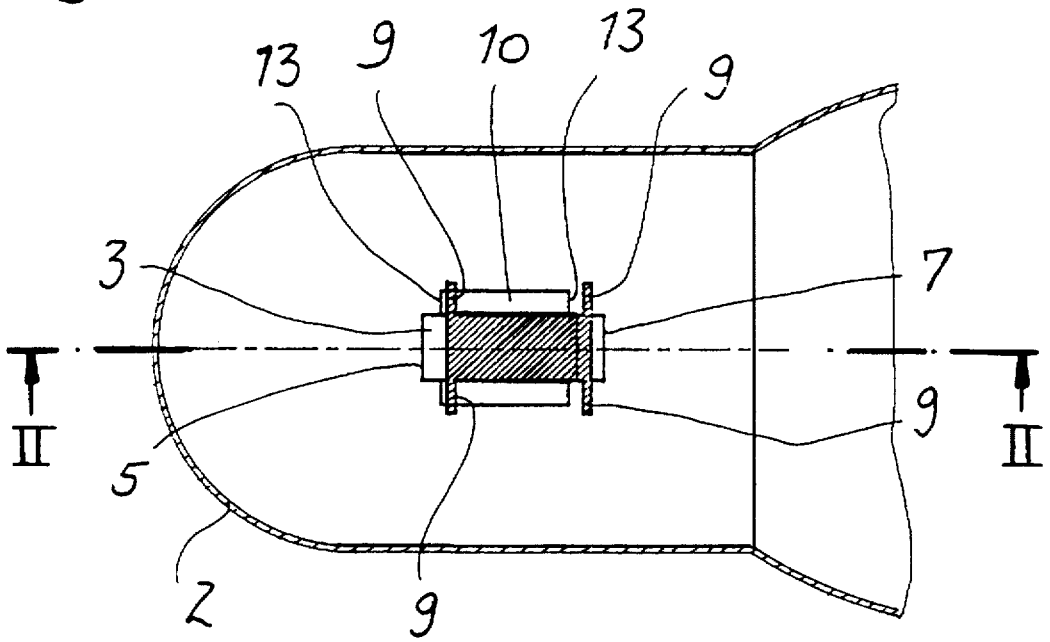
FIG. 1 is an axial and longitudinal section through the lamp assembly of this invention during installation of the socket.

As seen in FIGS. 1 though 7 a synthetic-resin lamp socket 1 is normally held in support or reflector 2 that is centered on a longitudinal axis A and that flares forwardly (to the right in FIG. 1). The support 2 is formed with a cruciform hole 3 (see FIG. 20) having front and back notches defining front and back edges 5 and 7 and side notches 10 in turn having front and back edges 13. The socket 1 is formed with a foot 4 that projects through this hole 3 and that has back and front tabs 6 and 8 that engage in and through the back and front notches at the edges 6 and 8 to reach under and engage the outer face of the reflector 2. The front tab 8 is much shorter than the rear tab 6 and the distance between the outer edges of these tabs 6 and 8 is somewhat greater than the longitudinal distance between the edges 5 and 7 while the distance from one of the edges (here the edge of the shorter tab 8) to the inner edge of the other tab where it joins the foot is substantially shorter than this distance so that the foot 4, which is rigidly formed with the tabs 6 and 8, can be fitted through the hole 3. In addition the foot 4 forms a pair of longitudinally spaced and transversely extending abutments 9 that engage the inner face of the reflector 2.

A plug 11 has a plate 15 that fits against the outer face of the reflector 2 over the tabs 6 and 8 and a pair of longitudinally extending and transversely deflectable tongues 16 of a longitudinal length slightly smaller than the longitudinal spacing between the edges 13 so that they can fit in the side notches 10. Each of these tongues 16 is formed with a longitudinally extending barb or ridge 12 that can coact with and catch on another such barb or ridge 14 (see FIG. 7) of the foot 4 to lock the plug 11 in place on the foot 4. Furthermore this plug 11 is formed with a throughgoing passage accommodating a two-conductor wire 17 that can be connected to terminals 24 on a lamp holder 23 in the socket 1. The plug 11 also has a swivel 18 for pivoting of the entire lamp assembly.

Figure 2:
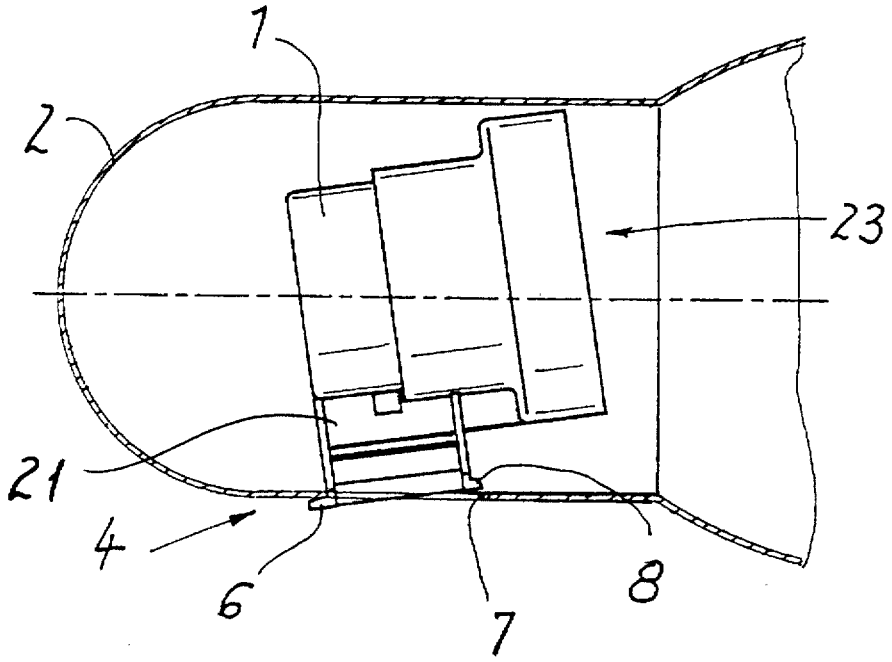
FIG. 2 is a section taken in the direction of arrows II—II of FIG. 1.
Figure 3:
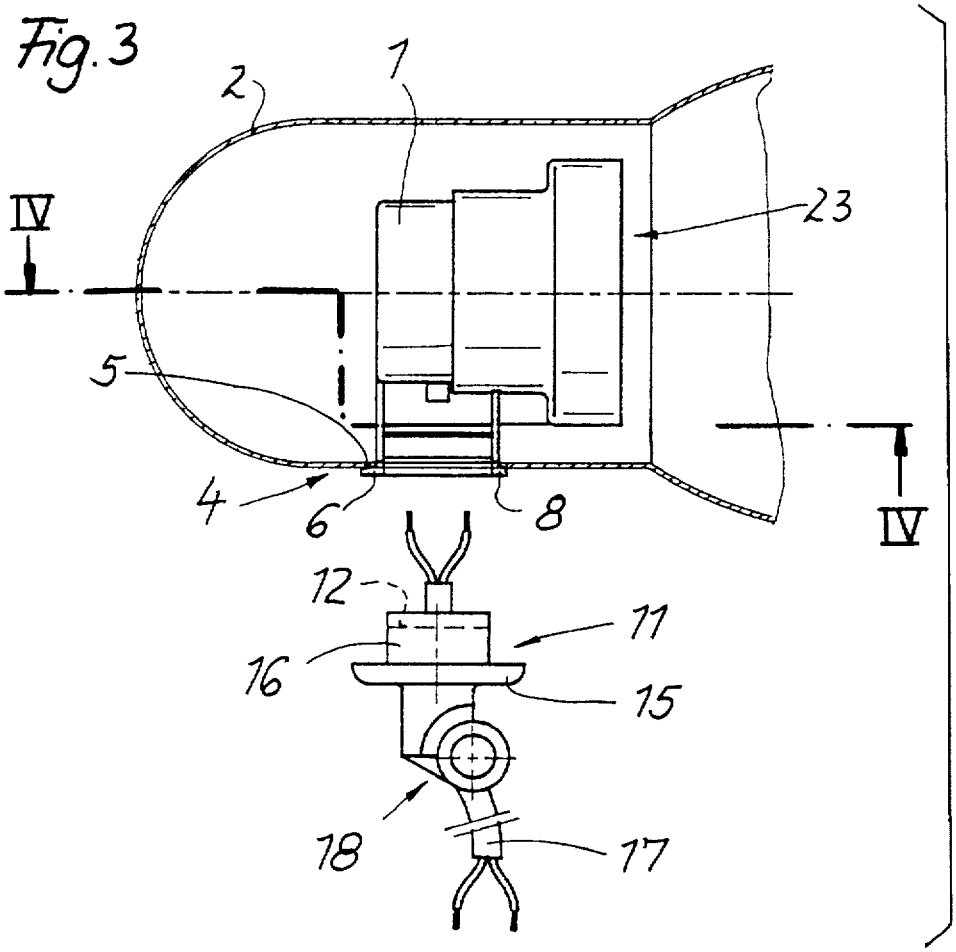
FIG. 3 is a side sectional view showing the lamp at a further step in its assembly
Figure 4:
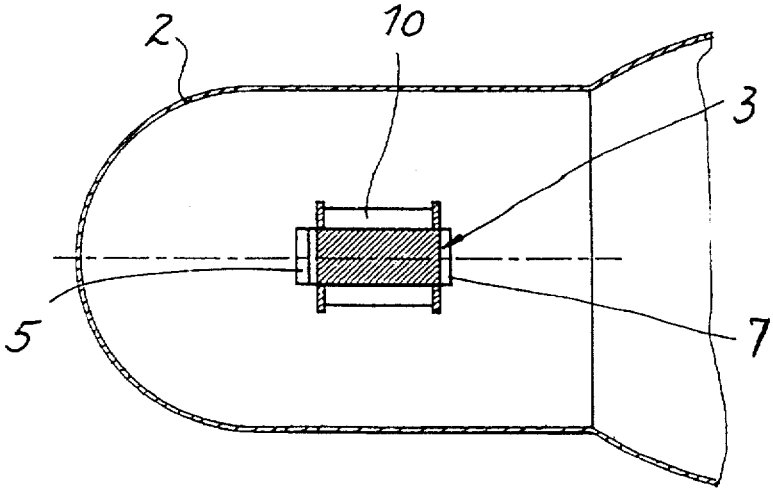
FIG. 4 is a section taken in the direction of arrows IV—IV of FIG. 3.
Figure 5:
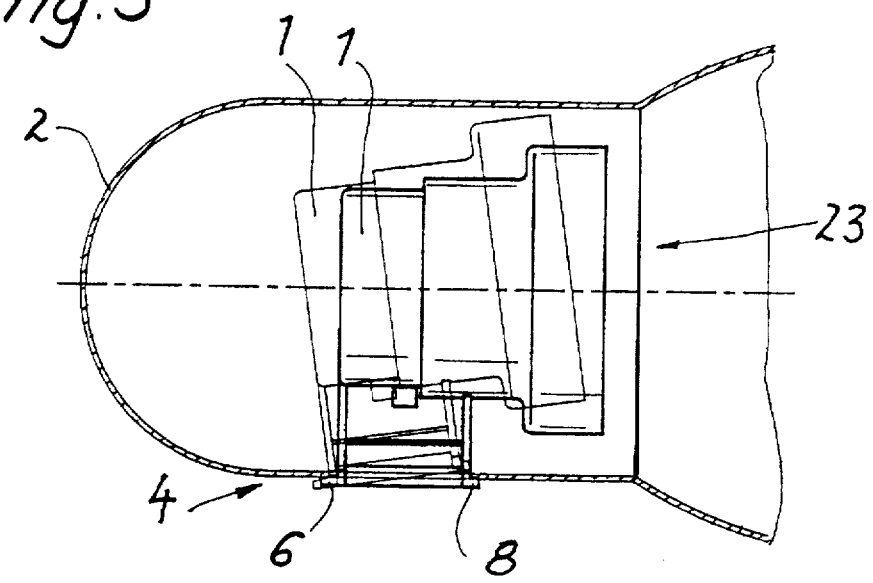
FIG. 5 is a side sectional view showing the lamp at a yet further step in its assembly.
Figure 6:
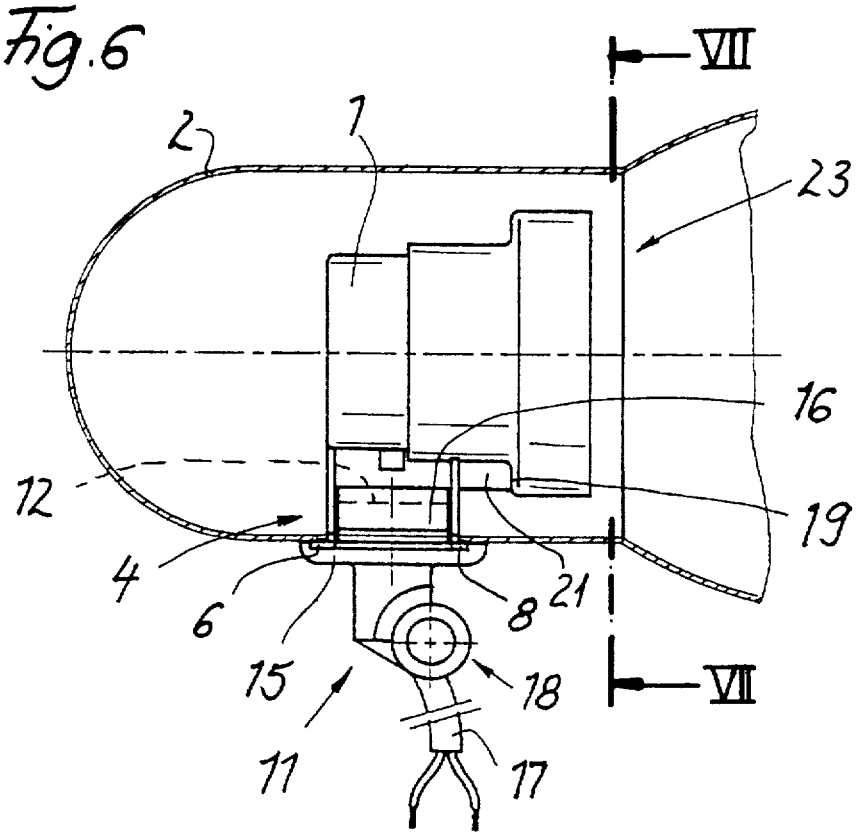
FIG. 6 is a side sectional view of the completely assembled lamp.
Figure 9:
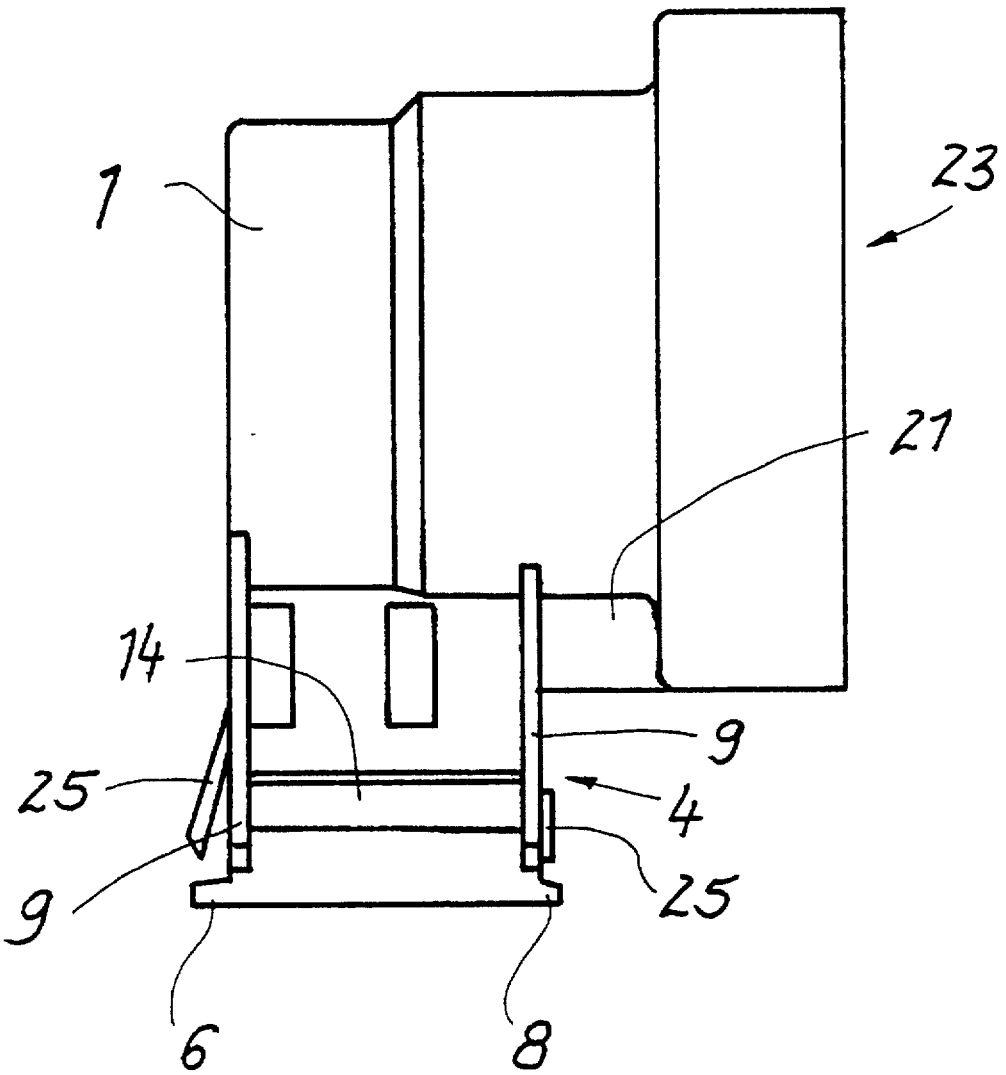
FIG. 9 is a side view of another lamp according to the invention.
Figure 10C:
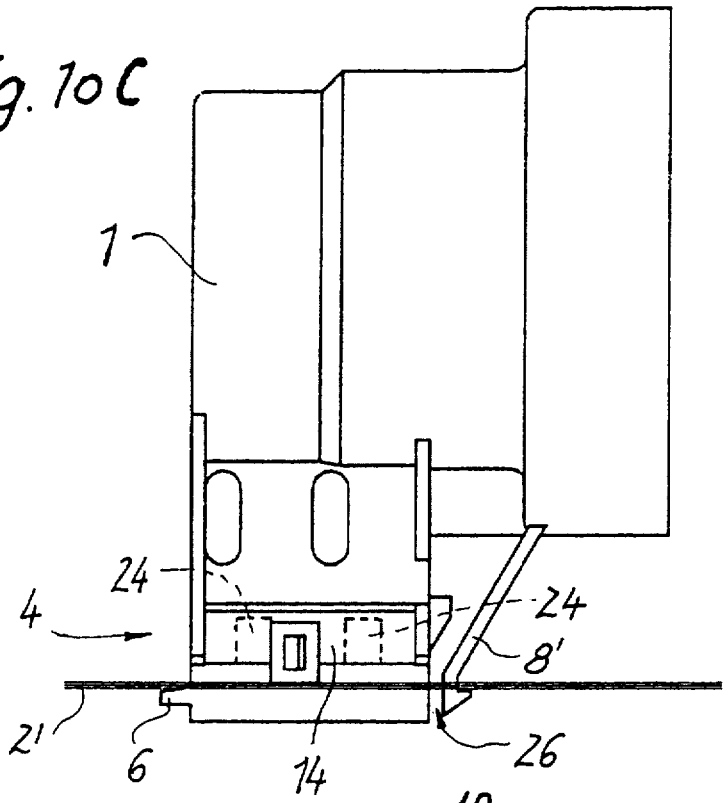
FIG. 10C is a side view of the socket used with the plug and support of FIGS. 10A and 10B.
Figure 10B:
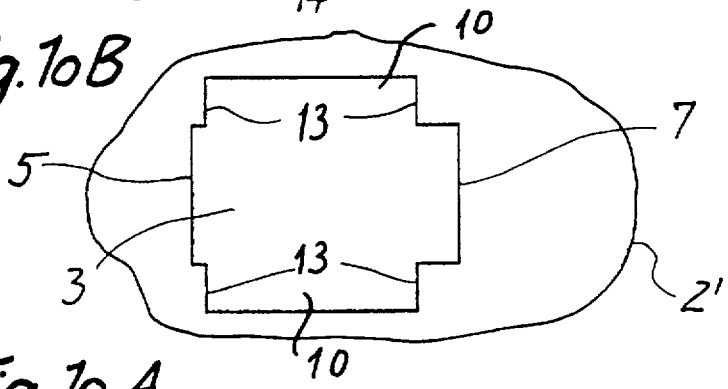
FIG. 10B is a top detail view of a portion of a support according to the invention.
Figure 10A:
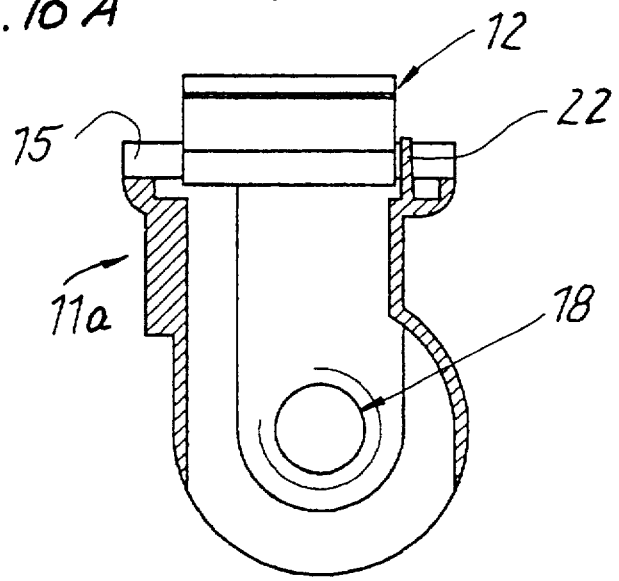
FIG. 10A is a side sectional view of a plug according to the invention.
Figure 11:
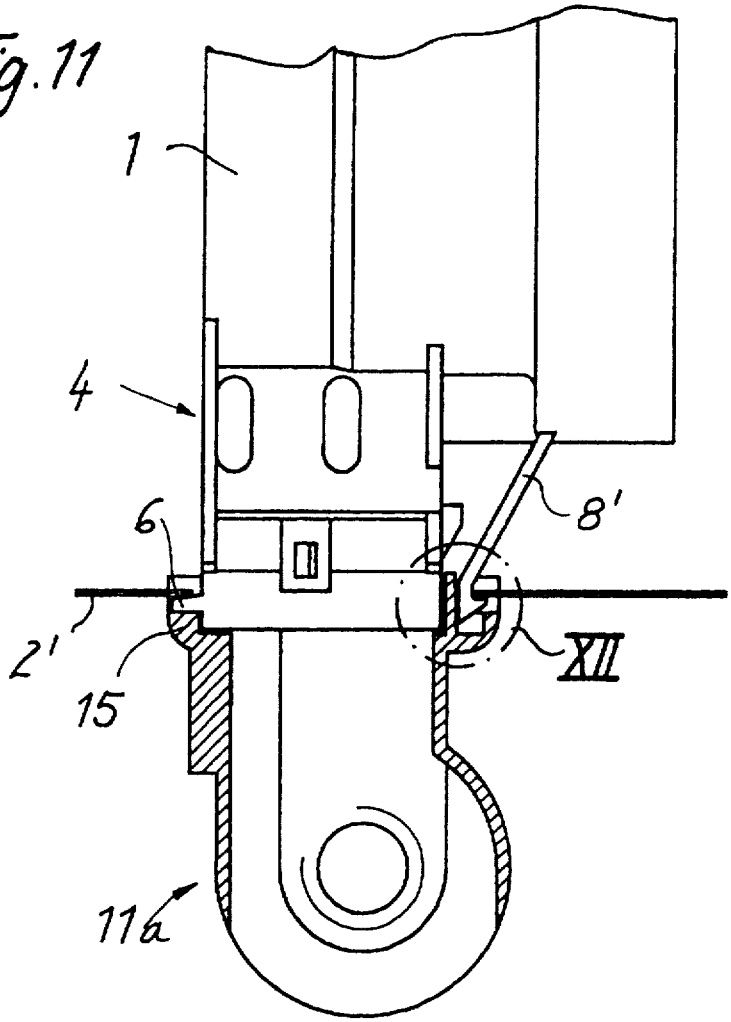
FIG. 11 is a side partly sectional view of the plug, support, and socket of FIGS. 10A, 10B, and 10C in assembled condition.
Figure 12:
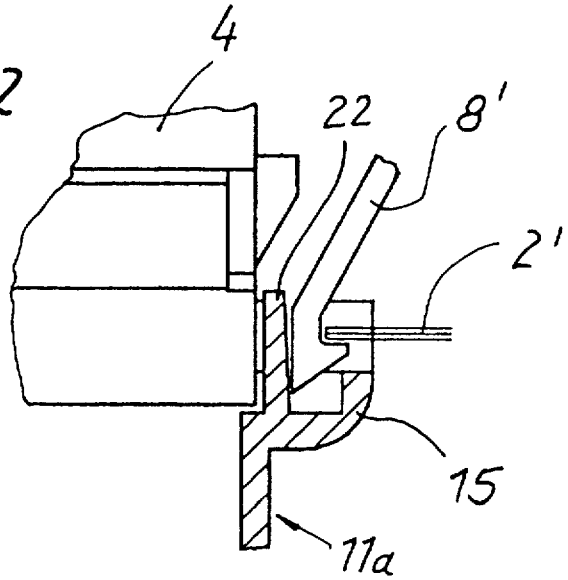
FIG. 12 is a large-scale view of the detail indicated at XII in FIG.
Figure 13B:
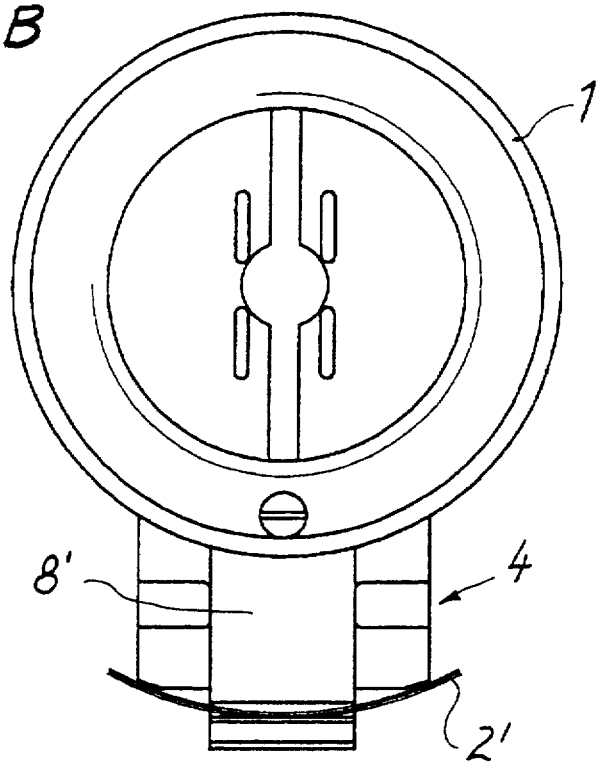
FIG. 13B is a front view of the support and socket used with the plug of FIG. 10A and also shown in FIGS. 10C and 11.
Figure 13A:
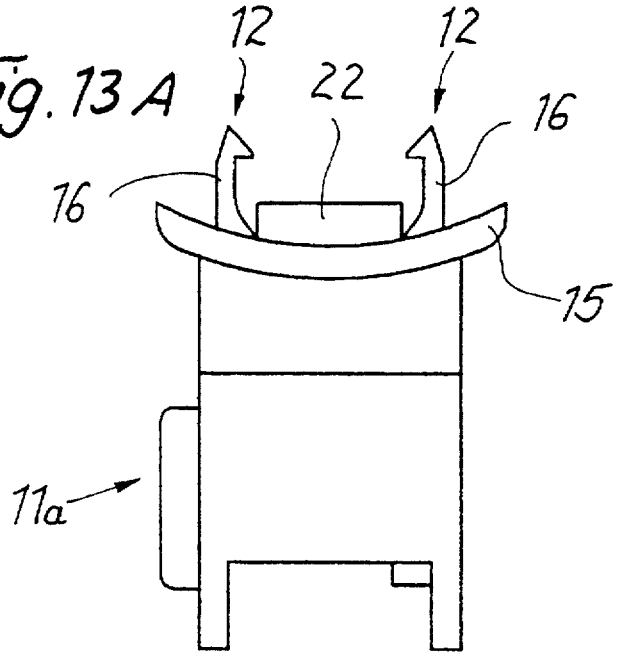
FIG. 13A is a front view of the plug of FIG. 10A.

For assembly a screwdriver or the like is inserted in a hole 20 formed in a transverse wall 19 of the socket 1. This hole 20 is rectangular and tangentially elongated and is extended backward in a channel 21 formed on the socket 1 so that the end of the screwdriver is effectively captured, making it easy to manipulate the socket 1 by means of the driver's handle. Then the long rear tab 8 is poked under the rear edge 5 as seen in FIGS. 1 and 2 and then the entire assembly is rocked down as indicated by FIG. 5 to the position of FIGS. 3 and 4, with the tab 8 outside the reflector 2. The socket 1 is then pulled forward somewhat to hook the front tab 8 under the front edge 7 and the connections are made at 24. Then the plug 11 is poked up into the hole 3 so that its tongues fit between the abutment plates 9 and the formations 12 and 14 clip onto each other. This secures the entire assembly solidly together without the use of tools or extra parts.

The arrangement of FIG. 8 is identical to that of FIGS. 1 through 7, except that the reflector 2 is replaced by a flat support 2' formed with the hole 3 in a recess.

FIGS. 9 through 13B show another arrangement where, instead of a rigid front tab 8, the foot 4 is formed with a transversely extending finger 8' whose lower end is barbed and longitudinally deflectable to engage under the front edge 7 of the hole 3. The outer end of the finger 8' forms a space or gap 26 with the foot 4 and, when this end is depressed back to close this gap 26, the foot 4 can be pulled out of the hole 3. The plug 11' however is formed with a wall portion 22 that substantially fills this gap 26 (see FIG. 12) when the assembly is complete to prevent it from coming apart. Furthermore the plug 11' has a skirt or shield 15 that engages around and protects the tab 6 and finger 8' in the completed assembly. FIG. 13A shows how the plate 15 can be part cylindrical to complementarily fit the socket 1.

In FIGS. 14, 15, and 16 the socket 11*b* has a sleeve-like base 27 that is internally threaded to be fitted over the upper end of a conduit.

The system of FIGS. 17 through 19 has a plug 11*c* whose base 29 is formed as a flat plate adapted to be secured to a substrate by means of screws 30.

Figure 20:
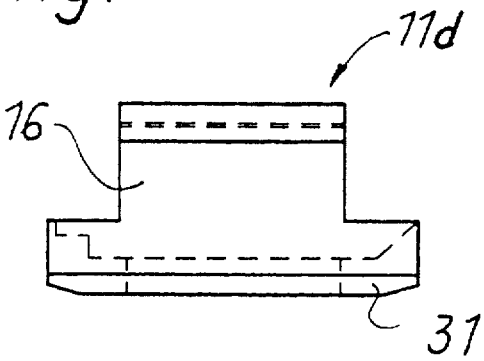
FIGS. 20, 21A, and 22 are side, end, and top views of another plug according to the invention.
Figure 21A:
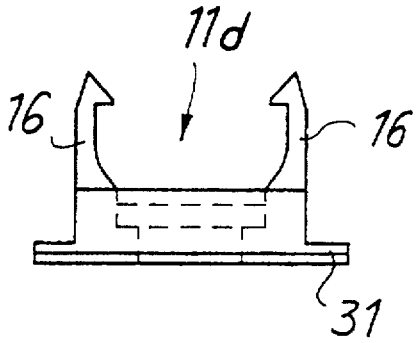
Figure 22:
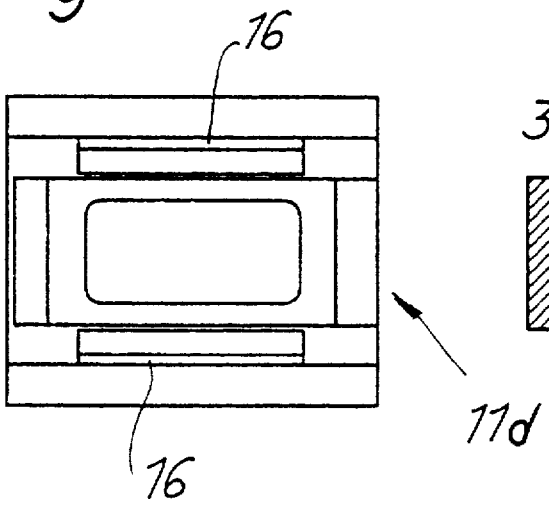
Figure 21B:
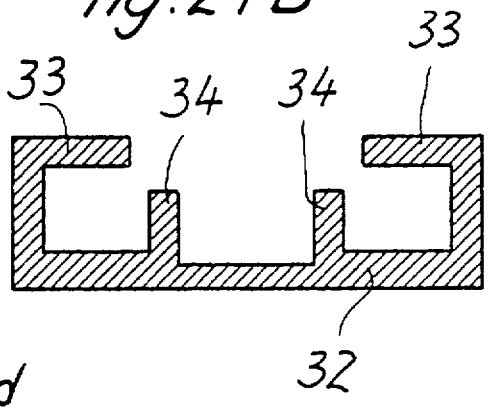
FIG. 21B is a cross section through a holder for the plug of FIG. 20.
Figure 21C:
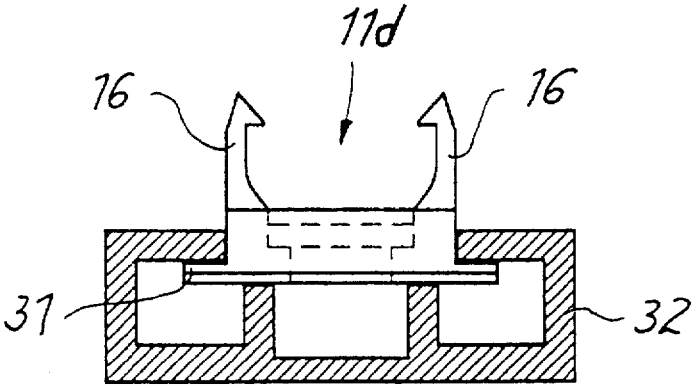
FIG. 21C is a sectional view illustrating the plug and holder of FIGS. 20, 21A, and 22 in assembled condition.

The plug 11*d* of FIGS. 20 through 22 has a base 31 formed as a slide with flanges 31 adapted to fit in a rail 32 underneath flanges 33 of this rail 32. The rail 32 is also formed with longitudinally extending ridges 34 on which a bottom surface of the plug 11d rides and between which the electric-supply wire for the lamp can be accommodated. Thus the slide plug 11*d* can be moved along the rail 32 in a track-lighting arrangement.

We claim:

1. A lamp assembly comprising:

a plate-like support having a pair of opposite faces and formed with a throughgoing cruciform opening having longitudinally confronting front and back notches and transversely confronting side notches, the front and back notches having respective straight front and back edges spaced apart by a predetermined first longitudinal distance, each side notch also having straight front and back edges spaced apart by a predetermined second longitudinal distance, all the front and back edges being generally parallel;

a synthetic-resin lamp holder having a longitudinally open socket and formed with a foot projecting generally perpendicularly of the socket and fitted to the opening, the foot being formed with respective longitudinally spaced front and back abutments engaging one of the faces of the support longitudinally forward and rearward of the side notches, respective front and back retaining tabs extending through the front and back notches to engage an other face of the support and having outer edges turned away from each other and spaced apart by a third longitudinal distance slightly greater than the first longitudinal distance and inner edges one of which is spaced from the outer edge of the other tab by a fourth longitudinal distance at most as great as the first longitudinal distance, the inner edges confronting and closely juxtaposed with the respective front and back edges of the front and back notches, and respective side retaining formations between the abutments and generally aligned with the side notches;

a plug having a surface engaging the other face of the support and formed with a pair of transversely deflectable tongues engaged in the side notches and each of a longitudinal dimension slightly smaller than the second longitudinal distance, the tongues being formed with portions releasably engageable with the respective side retaining formations; and an electrical wire extending through the plug, through the opening, and between the abutments to the socket.

2. The lamp assembly defined in claim 1 wherein the retaining tabs are rigid and fixed on the foot.

3. The lamp assembly defined in claim 1 wherein one of the retaining tabs is rigid and fixed on the foot and an other tab is formed as a deflectable finger extending from the foot and through the opening at the respective notch, the deflectable finger being spaced longitudinally from the foot at the opening to form a gap and the plug being formed with a wall portion generally filling the gap and thereby preventing deflection of the finger toward the foot.

4. The lamp assembly defined in claim 3 wherein the finger has an outer end hooked through the opening and engaging the other face of the support.

5. The lamp assembly defined in claim 3 wherein the plug is formed with a shield portion engaging around the outer end of the finger.

6. The lamp assembly defined in claim 1 wherein the foot is formed with a throughgoing passage receiving the wire.

7. The lamp assembly defined in claim 1 wherein the retaining formations are barbs formed on the foot, the tongues being formed as hooks engageable over the respective barbs.

8. The lamp assembly defined in claim 1 wherein the socket is centered on a longitudinally extending axis and is formed with a wall extending generally perpendicular to the axis and formed with a longitudinally forwardly open recess, whereby a tool can be engaged in the recess to steady the socket as the foot is fitted to the opening.

9. The lamp assembly defined in claim 8 wherein the recess has a generally rectangular mouth extending tangentially of the axis.

10. The lamp assembly defined in claim 8 wherein the recess is immediately adjacent the foot.

11. The lamp assembly defined in claim 8 wherein the socket is formed with a longitudinally extending passage forming the recess.

12. The lamp assembly defined in claim I wherein the support is a longitudinally flaring reflector.

13. The lamp assembly defined in claim i wherein the plug is formed with a swivel joint.

* * * * *